United States Patent [19]

Morgan, Jr. et al.

[11] 4,259,793

[45] Apr. 7, 1981

[54] LIGHT WEIGHT, HIGH TRACTION SNOW SHOE

[75] Inventors: C. Baird Morgan, Jr., Pittsford, Vt.; Fred H. Alexy, Cleverdale; Robert E. Geh, Putnam Station, both of N.Y.

[73] Assignees: Vermont Tubbs, Inc., Forestdale, Vt.; AMG Industries, Inc., Glen Falls, N.Y.

[21] Appl. No.: 66,716

[22] Filed: Aug. 15, 1979

[51] Int. Cl.[3] ..... A43B 5/04

[52] U.S. Cl. ..... 36/125

[58] Field of Search ..... 36/122, 123, 124, 125

[56] References Cited

U.S. PATENT DOCUMENTS

| | | | |
|---|---|---|---|
| 982,053 | 1/1911 | Haefer | 36/125 |
| 1,004,900 | 10/1911 | Pease | 36/124 |
| 3,299,541 | 1/1967 | Snyder | 36/125 |
| 3,992,790 | 11/1976 | Frye | 36/125 |

FOREIGN PATENT DOCUMENTS

| | | | |
|---|---|---|---|
| 542885 | 7/1957 | Canada | 36/125 |
| 634114 | 1/1962 | Canada | 36/122 |

*Primary Examiner*—Patrick D. Lawson

*Attorney, Agent, or Firm*—Sughrue, Rothwell, Mion, Zinn and Macpeak

[57] ABSTRACT

A unitary, light weight metal I-beam frame member of generally oval plan configuration bears a first transverse spreader rod between lateral sides to support a flat swivel toe plate which extends across the top of the rod. The plate has fixed at its center a flexible strip material toe binding for partial wrapping of its opposite lateral sides about the toe of an inserted boot of the snow shoe wearer. The I-beam frame carries opposed sharp edges at its base for improved traction. Flexible sheet material pads are laced to the interior of the frame forward and aft of the binder to resist snow shoe penetration into the snow field during use. A U-shaped traction device is fixed to the bottom of the I-beam frame member, beneath the toe plate, and is notched on its lower edge to bite into the snow.

8 Claims, 13 Drawing Figures

LIGHT WEIGHT, HIGH TRACTION SNOW SHOE

FIELD OF THE INVENTION

This invention relates to snow shoes, and more particularly, to a light weight snow shoe construction facilitating attachment to the boot of the wearer and movement of the snow shoe over the snow during use.

BACKGROUND OF THE INVENTION

Snow shoes have been employed since the earliest settlers first came to this country for traversing the deep snow with minimal effort. Historically, wooden saplings and the like have been bent into modified oval plan configuration and gut or the like has been laced to the frame member to provide both a basis for coupling or connecting the snow shoe to the boot of the wearer and for preventing penetration of the snow shoe beneath the surface of the snow during snow traversal.

The wooden framing is not only heavy, but being wooden is subject to breakage. Maintenance is required. Rawhide used for stringing picks up moisture and the weight due to the moisture adversely affects its use by the wearer.

It is, therefore, a primary object of the present invention to provide an improved light weight snow shoe providing superior flotation, high traction, and reduced mass, to permit virtually effortless traverse of the snow fields.

It is a further object of the present invention to provide an improved, light weight, high traction snow shoe in which the normal and necessary movement of the wearer in traversing the snow field on the snow shoes is facilitated by an improved binding for pivotably connecting the wearer's boot to the snow shoe.

SUMMARY OF THE INVENTION

The improved, light weight, high traction snow shoe of the present invention comprises a unitary light weight metal I-beam frame member of modified oval plan configuration, having at least one rod fixedly mounted to the frame member and extending transversely between opposite lateral sides thereof at a position forward of the transverse center line. Steel cable coated with HYTREL$_{TM}$ (a trademark of the Dupont Corporation) filament webbing is carried by the frame member between opposed sides of said frame member and extending rearwardly of said transverse rod. A flat swivel toe plate is pivotably mounted on said transverse rod and extends across the top of the rod, being generally coplanar with the upper edge of the frame member. A nitrile belting toe binding is fixedly mounted at its center to the top of the toe plate and includes portions extending to each side thereof for partial wrapping about the toe of an inserted boot of the snow shoe wearer. At least a toe strap is fixed at one end to one side of the toe binding and is laced across opposite lateral edges of the strip material toe binding to lock the toe of the inserted boot to the pivotably flat toe plate.

Preferably, the I-beam frame member comprises a base having sharp right angle corners at opposed edges, joined at its center by a riser or vertical wall to a corresponding upwardly convex rim having rounded edges to provide high traction to the snow shoe but absent an abrasive cutting edge along the upper rim. The vertical wall joining the base to the rim for the I-beam frame member is preferably perforated throughout its length for filament lacing between opposed portions and imperforate flexible material pads are laced at their periphery, to front and rear portions of the frame member to prevent penetration of the surface of the snow during use. The swivel toe plate is preferably T-shaped in vertical cross-section, including an integrally molded tubular projection at its center, bored to receive said transverse rod and said rod bears locking rings on each side of the pivot plate with thin, flanged, cylindrical nylon bearings interposed on said transverse rod between the ends of said pivot plate and said locking rings, and between the transverse rod and the molded tubular projection of the swivel toe plate.

Preferably, a plurality of D-rings are mounted to the edge of the flexible strip material toe binder. A toe strip is fixed at the front of the flexible strip material toe binding for lacing through the D-rings so as to lace the lateral edges of the flexible strip material toe binding about the toe of the inserted boot. The flexible strip material toe binding further comprises a spring biased clamp carried along one lateral edge at the rear thereof for clamping the free end of the toe strap. A heel strap having one end fixed to one side of the flexible strip material toe binding at the rear thereof, and said flexible strip material toe binding on the opposite side carries a second spring biased clamp for gripping the free end of said heel strap to thereby facilitate locking of the boot coupled to the snow shoe to the flexible strip material toe binding.

A U-shaped metal strip is mounted beneath the frame member and has a base or central portion which spans between opposed sides of the frame member and is fixed to the spreader bar, the strip defining a traction device and bearing a plurality of notches on its lower edge for biting into the snow. The traction device may be applied to snow shoes other than those constructed of metal and in the manner of the illustrated snow shoe which bears the traction device as illustrated.

DESCRIPTION OF THE PREFERRED EMBODIMENT

Figure 1:
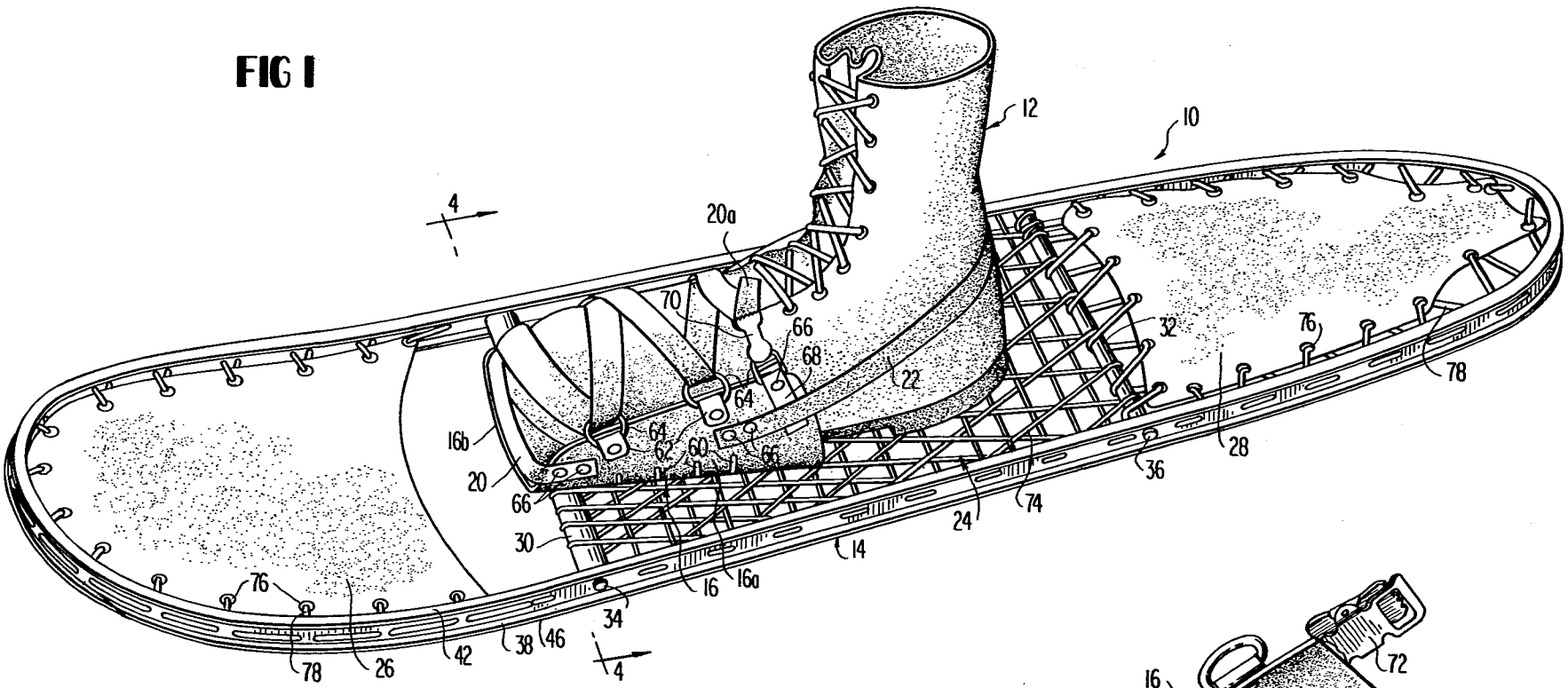
FIG. 1 is a perspective view of a preferred embodiment of the improved, light weight, high traction show shoe of the present invention coupled to a boot of the snow shoe wearer.
Figure 5:
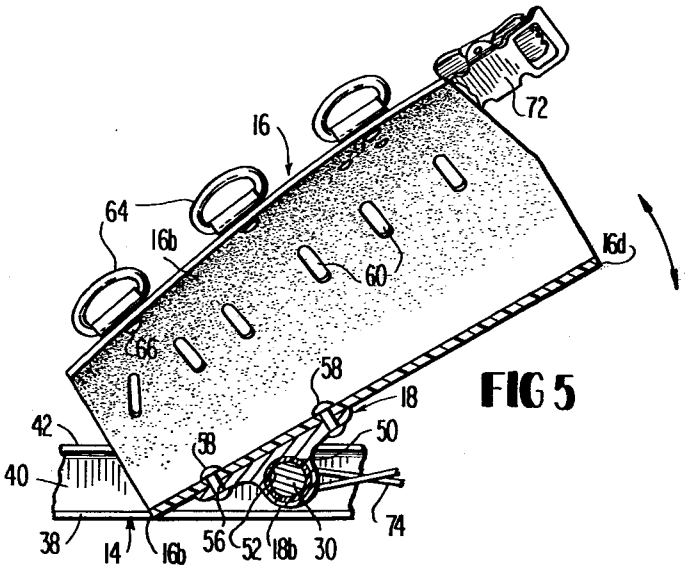
FIG. 5 is a vertical sectional view of a portion of the snow shoe of FIG. 4 taken about line 5—5.
Figure 3:
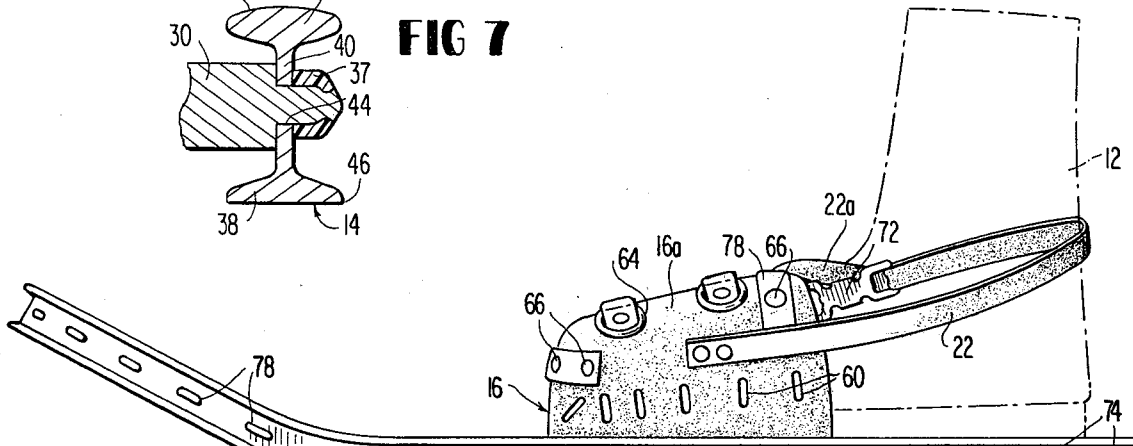
FIG. 3 is a side elevational view of the snow shoe of FIG. 1.

Referring to the drawings, there is shown a preferred embodiment of the present invention constituting a light weight, high traction show shoe indicated generally at 10 and as illustrated in FIGS. 1 and 3, being connected to the user's boot, indicated generally at 12, by way of a toe fitting indicated generally at 16, which highlights the present invention along with the unitary or single piece I-beam frame member, indicated generally at 14. The frame member is oval and includes a central and rear flat portion terminating at its forward end in an upwardly inclined tip portion. Connection is achieved through the use of a flat swivel toe plate indicted generally at 18, which is pivotably borne by a first, forward transverse rod or spreader bar 30. A second, rearward transverse rod or spreader bar 32 extends between opposed lateral sides of the frame member 14 to the rear of boot 12. Collars on the ends of said bar fix the bar to opposed sides of said frame member 14. Coupling of the boot 12 to the snow shoe is further achieved through the use of a toe strap 20 and a heel strap 22, which straps are laced or otherwise wrapped and buckled or clamped to achieve a non-releasable connection between the boot 12 and the snow shoe. In somewhat conventional fashion, a webbing formed of a synthetic line such as plastic monofilament, synthetic or natural gut lacing as at 24 complements the toe plate carried flexible strip material toe binding 16. To the front of forward transverse rod 30, there is provided an imperforate flexible material pad as at 26 and to the rear of rearward transverse rod 32, there is provided an imperforate, flexible material pad 28. The pads are laced to the one piece I-beam frame 14 and prevent the snow shoe from deeply penetrating the surface of the show field, over which the operator traverses.

Figure 4:
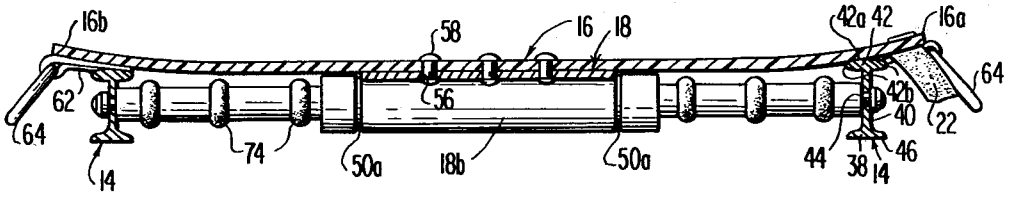
FIG. 4 is a vertical sectional view of the snow shoe of FIG. 1 taken about line 4—4.
Figure 6:
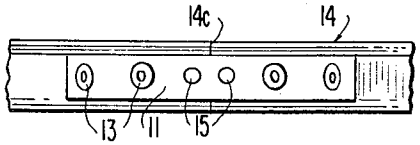
FIG. 6 is a rear view of a portion of the snow shoe of FIG. 1 illustrating the arrangement for connecting opposed ends of the single element I-beam frame member to form an endless oval loop.

As mentioned previously, one of the principal aspects of the present invention involves utilization of a unitary or one piece I-beam frame or member 14 which, as seen in FIG. 4, comprising integrally, in cross-section a base 38, joined at its center by way of a vertical riser or wall 40 and an upper overlying rim 42. The base 38 in cross-section is of thin modified rectangular configuration in which the bottom is flat with right angle corners and the upper portion is curved, defining opposed, sharp right angle edges as at 46 to effect excellent traction with respect to snow over which the member traverses. Further, the rim 42 has its upper surface as at 42*a*, convex so as to along with opposed rounded edges 42*b*, prevent abrasion when contacting objects during use. The risers 40 are apertured as at 44 to receive the projecting, reduced diameter tips of the transverse rods 30 and 32, at 34, 36, respectively. Deformable locking sleeves 37 may be employed to secure the ends of rods to the risers 40. Further by reference to FIG. 6, it is seen that the construction of the one piece I-beam frame of the unit that the closed loop of the frame is achieved through the utilization of a pair of thin aluminum strips which sandwich the riser 40 at the break line 14*c*, FIG. 2, the outside strip being shown at 11, including a plurality of holes as at 15 at longitudinally spaced positions through which holes 15 project rivets as at 13 such that strip 11 on the outside and the corresponding strip on the inside of the riser are mechanically locked to each other, thus acting mechanically complete the joint between opposed, abutting and contacting ends of the single element I-beam defining frame 14.

Mechanically, in completing the oval shaped frame member, rods 30 and 32 are interposed transversely between opposed sides of the I-beam frame member 14 with the reduced diameter tips 34 and 36, respectively, positioned within appropriate holes 44 within riser 40 of the I-beam frame member. Additionally, rods 30 and 32 are secured to the frame by a swaged collar.

As a subassembly, the flat, swivel toe plate 18 is mounted to the forward, transverse rod or spreader bar 30 and maintained at a central position intermediate of the ends of that member by paired locking rings 48 on each side of the central, downwardly projecting tubular portion 18*b* which is bored at 52 to a diameter slightly in excess of the diameter of nylon bearing cylinders 50. Preferably, the thin nylon bearing cylinders 50 are flanged at their ends, as at 50*a*, are interposed end-to-end between the locking rings 48 and the tubular projection 18*b* to form a low friction bearing permitting ease in swiveling of the plate 18 about the axis of rod 30. The plate 18 bears in the illustrated embodiment six holes 56, three to each side of rod 30, facing rows extending parallel to the axis of the rod 30 and acting to receive rivets 58 which rivet the central portion of the flexible strip material toe binding 16 to plate 18. Further, the swivel toe plate 18 is riveted to the binding near its forward edge 16*b* such that during traverse of the snow field, the boot is lifted at its heel portion away from the webbing provided by the filament 24 without, of course, dislodging the boot from its toe binding 16. The toe binding 16, which preferably comprises a composite layer of flexible sheet material of plastics and/or rubber construction and may comprise nitrile belting, being sufficiently flexible such that its sides as at 16*a*, 16*b* fold about the side of the boot from the toe rearwardly towards the heel and is lashed to the boot 12 by the toe strap 20. Strap 20 is riveted at one end by rivets 66 to side 16*a* just rearwardly of the forward edge 16*b* of that member. A plurality of D-rings as at 64 are mounted through the use of short mounting straps 62, also riveted to the sides 16*a* and 16*b* of the toe binding 16 along opposed lateral edges of this flexible sheet material. In order to hold the free end 20*a* of the toe strap 20, there is provided a spring type clamp or buckle 70 which is rivet attached to a buckle strap 68 on side 16*a* of the toe binding by rivet 66 and a similar spring clamp or buckle 72 is provided at the rear 16*d* of the binding adjacent the lateral edge of portion 16*b* of that member. Further, slots as at 60 on each side of the longitudinal center line of the toe binding 60, which is virtually the same binding as used on other snow shoes, provide for mounting the binding to the snow shoe. The heel strap 22 is attached at one end to the side 16*a* of the toe binding 16 by way of rivets 66, the heel strap 22 extending rearwardly with the free end 22*a* being clamped within spring clamp 72, FIG. 3.

A further aspect of the present invention is the utilization of the imperforate flexible sheet metal pads as at 26 and 28 stretched internally of the frame member. The pads may be formed of HYPALON, a trademark of the DuPont Corporation. Pad 26 lies forward of the transverse rod 30 and pad 28 rearwardly of the transverse rod 32. The pads 26 and 28 are preferably formed of HYPALON material. The peripheral edge of the pads is provided with circular grommets as at 76 through which pass the plastic filament strings as at 78 for pad 26 and 78 for pad 28, in the case of pad 28 the string also being wrapped to transverse rod 32. This provides improved resistance to penetration of the surface of the snow during use of the snow shoe and acts in conjunction with the webbing 24 as defined by the crisscrossed strings of the synthetic gut or like material 74.

Figure 2:
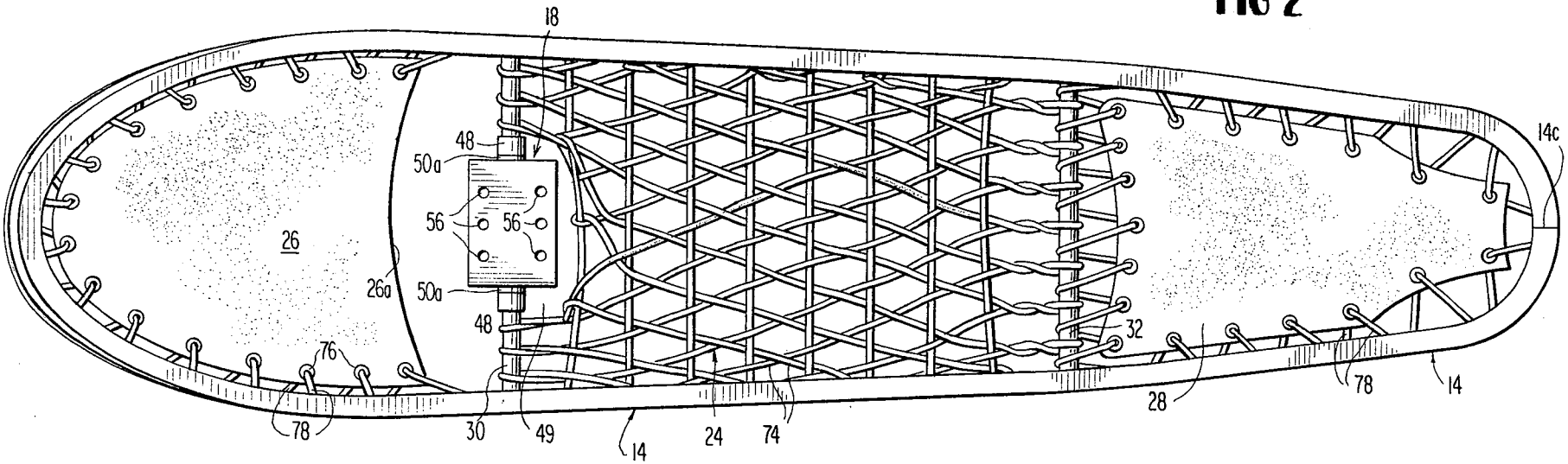
FIG. 2 is a top plan view of the snow shoe of FIG. 1 with the flexible strip material toe binding removed therefrom.

It may be seen in FIG. 2 that the webbing occurs over almost the complete area between the sides of the frame member and the forward and rearward transverse rods 30 and 32, except for an area 49 in the immediate vicinity of the swivel plate 18. Further, the rear edge 26*a* of the pad 26 is spaced some distance from the forward transverse rod 30 to prevent interference of the pad 26 with the pivoting of the swivel toe plate 18 and the attached boot 12 during snow traverse by the wearer.

Figure 7:
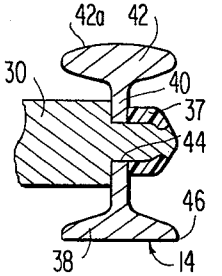
FIG. 7 is an enlarged, sectional view of a portion of the spreader bar at its intersection at one end with the frame member.
Figure 12:
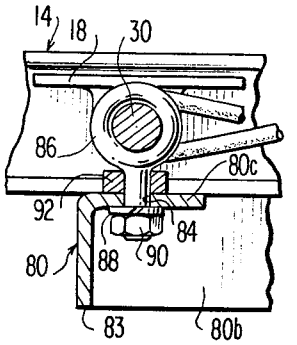
FIG. 12 is a sectional view taken about line 12—12 of FIG. 8.
Figure 13:
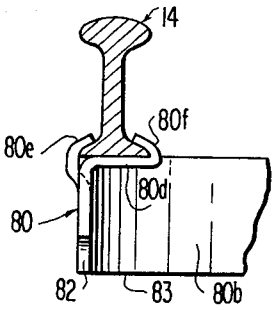
FIG. 13 is a sectional view of the portion of the snow shoe shown in FIG. 10 taken about line 13—13.
Figure 9:
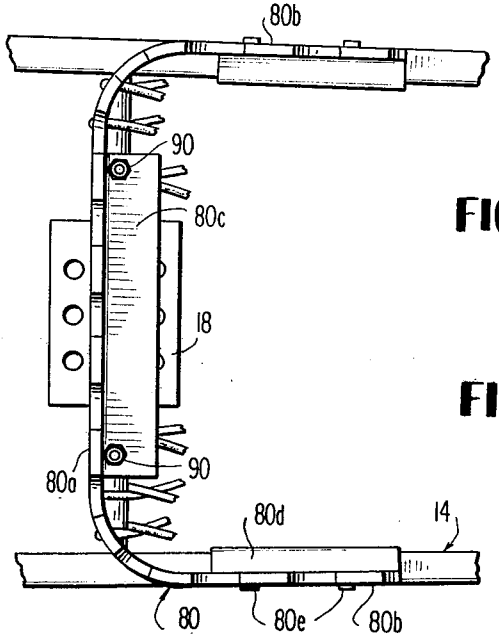
FIG. 9 is a bottom plan view of the portion of the snow shoe shown in FIG. 8.
Figure 11:
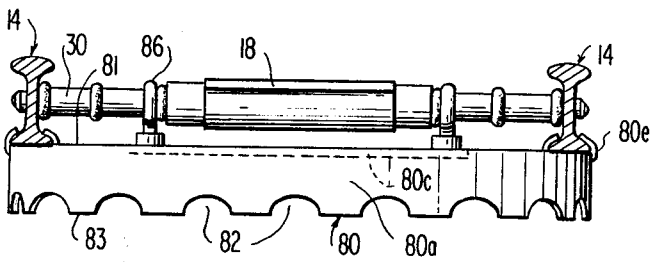
FIG. 11 is a front end view of the portion of the snow shoe shown in FIG. 8.
Figure 8:
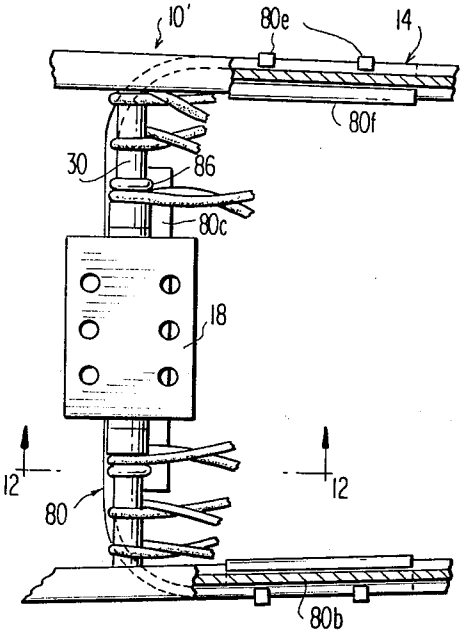
FIG. 8 is a top plan view of a portion of the snow shoe showing the toe plate and traction device in an alternate embodiment of the invention.
Figure 10:
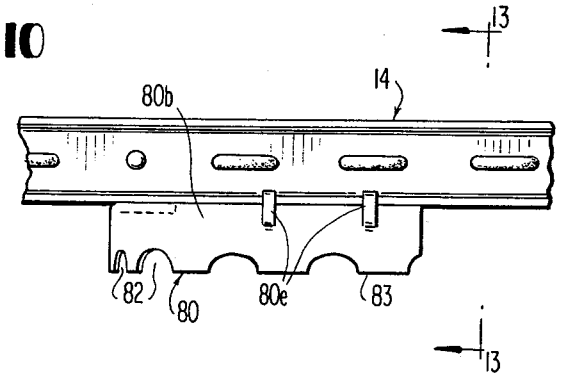
FIG. 10 is an enlarged, side elevational view of the portion of the snow shoe shown in FIG. 8.

A further important aspect of applicants' invention resides in the utilization of a traction device, either as a separate element for attachment to existing snow shoes, or preferably for attachment to the snow shoe as it appears in FIGS. 1–7 inclusive. In the embodiment of the invention shown in FIGS. 8—13 inclusive, like elements to the first embodiment are given like numerical designations. In that respect, the snow shoe indicated generally at 10, is also comprised of an I-beam frame member indicated generally at 14, and a spreader bar 30 is fixed to and extends between opposed sides of the frame member and being mounted to that frame member in the same manner as illustrated in FIG. 7. In this case, the forward transverse rod or spreader bar 30 bears the swivel plate 18 in the manner of the first embodiment. However, in addition, this spreader bar 30 has fixedly mounted thereto a traction device indicated generally at 80. The traction device 80 takes the form of a U-shaped mental strip including a central or base portion 80*a* and generally right angle, opposed side portions 80*b*. The base portion 80*a* is provided with an integral, right angle flange portion 80*c* which permits mounting of the traction device 80 to the spreader bar 30. Further, the side portions 80*b* are provided with integral flanges at the top as at 80*d* which bear upon the bottom of the I-beam frame member 14. The traction device which may be formed of stainless steel sheet metal strip, for instance, is provided with an upper edge 81 which is flat and a lower edge 83 which is notched by way of a series of curved notches 82 spaced apart, and extending from one end to the other of the traction device. The notches provide for traction since they permit the traction device to grip the snow.

To facilitate the mounting and fixing of the traction device to the improved snow shoe structure of the first embodiment of the invention, the flange 80*c* is provided with two aligned holes as at 84 through which extend the threaded ends of closed eye bolts 86 having a diameter in excess of that of the transverse rod or spreader bar 30, through which the bar passes. An annular spacer 92 is provided between the headed end of the closed eye bolts 86 and the flange 80*c*, and a lock nut as at 90 and washer 88 are carried by the threaded projecting end of the closed eye bolt 86, permitting the lock nut 90 to be tightened to rigidly secure the traction device to rod 30 at axially spaced locations.

Further, and in this particular instance, the side portions 80*b* by way of their integral flanges 80*d*, permit clamping of the spacer 92 of the traction device on opposite sides to respective opposed portions of the I-beam frame member 14. Lip 80*f* of the flange 80*d* is bent about the base of the I-beam while on the opposite side a pair of clamping strips or tongues 80*e* integral with the side portions 80*d*. Clamping strips or tongues 80*e* may be partially struck out of the U-shaped traction device metal strip or otherwise formed. The purpose is to insure by way of lip 80*f* and the tongues 80*e* the gripping of the base of the I-beam frame member by the side portions 80*b* to lock the side portions 80*b* of the traction device to this portion of the snow shoe 10'. The washers 92 may be formed of metal or of a resilient material such as hard rubber or the like. Further, while the traction device 80 may be incorporated as an integral part of the snow shoe 10', the traction device 80 may be sold separately for application to snow shoes other than the one illustrated in the FIGURES of this application. Further, the manner of physically coupling the traction device 80 to the snow shoe may be achieved by means other than the closed eye bolts and the physical deformation of the flange lip and clamping tongue of the side portions 80*b* of the U-shaped strip formed traction device.

While the invention has been particularly shown and described with reference to a preferred embodiment thereof, it will be understoood by those skilled in the art that various changes in form and details may be made therein without departing from the spirit and scope of the invention.

What is claimed is:

1. An improved, light weight, high traction snow shoe comprising:

a unitary, light weight I-beam frame member of generally oval plan configuration, defining a horizontally flat middle and rear portion and terminating at its forward end in an upwardly inclined tip, said I-beam frame member comprising a base defining relatively sharp edges on opposite sides of the bottom face thereof, a riser extending vertically with respect to said base and terminating at its upper end in an integral transverse rim having a convex upper surface and curved opposed edges to prevent abrasion by said rim in contacting elements laterally thereto while said bottom face edge insures high traction with the snow field during use due to the sharp edges thereof, at least one spreader bar fixedly mounted to said frame member and extending transversely between opposed lateral sides thereof at the forward end of the flat central section, webbing carried by said frame member between opposed lateral sides of said frame member and extending rearwardly of said transverse bar, a flat swivel toe plate pivotably mounted on said transverse bar for rotation about the axis of said bar and extending across the top of said bar and generally coplanar with the upper edge of said frame member, a flexible strip material toe binding fixedly mounted to the top of said toe plate and having lateral portions extending to each side thereof, and at least one strap fixed at one end to one side of said toe binding, and means for effecting lacing of said strap across opposite lateral edges of said toe binding to clamp said binding to an inserted boot toe of the snow shoe wearer's boot, such that during traverse of the snow field, the wearer pivots the boot toe about the axis of said transverse bar on said swivel toe plate.

2. An improved, light weight high traction snow shoe comprising:

a unitary, light weight I-beam frame member of generally oval plan configuration, defining a horizontally flat middle and rear portion and teminating at its forward end in an upwardly inclined tip, at least one spreader bar fixedly mounted to said frame member and extending transversely between opposed lateral sides thereof at the forward end of the flat central section, webbing carried by said frame member between opposed lateral sides of said frame member and extending rearwardly of said transverse bar, a flat swivel toe plate pivotably mounted on said transverse bar for rotation about the axis of said bar and extending across the top of said bar and generally coplanar with the upper edge of said frame member, a flexible strip material toe binding fixedly mounted to the top of said toe plate and having lateral portions extending to each side thereof, at least one strap fixed at one end to one side of said toe binding, means for effecting lacing of said strap across opposite lateral edges of said toe binding to clamp said binding to an inserted boot toe of the snow shoe wearer's boot, such that during traverse of the snow field, the wearer pivots the boot toe about the axis of said transverse bar on said swivel toe plate, and wherein said flat swivel toe plate includes integrally, a central downwardly projecting transverse tubular portion having a bore therein of a diameter slightly larger than the diameter of said transverse bar and being rotatably mounted thereon, and wherein said bar further comprises a pair of clamping rings on opposite sides of said toe plate fixed to said transverse bar and preventing lateral shifting of said toe plate, and wherein a pair of thin cylindrical nylon radial thrust bearings are interposed between said clamping ring transverse bar and respective sides and bore of said tubular projection to provide a low friction bearing for said toe plate relative to said transverse bar.

3. An improved, light weight, high traction show shoe comprising:

a unitary, light weight I-beam frame member of generally oval plan configuration, defining a horizontally flat middle and rear portion and terminating at its forward end in an upwardly inclined tip, at least one spreader bar fixedly mounted to said frame member and extending transversely between opposed lateral sides thereof at the forward end of the flat central section, webbing carried by said frame member between opposed lateral sides of said frame member and extending rearwardly of said transverse bar, a flat swivel toe plate pivotably mounted on said transverse bar for rotation about the axis of said bar and extending across the top of said bar and generally coplanar with the upper edge of said frame member, a flexible strip material toe binding fixedly mounted to the top of said toe plate and having lateral portions extending to each side thereof, at least one strap fixed at one end to one side of said toe binding, means for effecting lacing of said strap across opposite lateral edges of said toe binding to clamp said binding to an inserted boot toe of the snow shoe wearer's boot, such that during traverse of the snow field, the wearer pivots the boot toe about the axis of said transverse bar on said swivel toe plate, said riser of said I-beam frame member comprising a plurality of longitudinally spaced holes extending transversely therethrough and string material is laced in criss-cross fashion to said frame member and to said at least one transverse bar to form said webbing which underlies the flexible toe binding extending rearwardly of said flat swivel toe plate and the wearer's boot carried thereby, and thin, imperforate, flexible sheet material pads laced to said I-beam frame member via said I-beam riser holes forward of said at least one transverse bar and said flat swivel toe plate, and at the rear of said frame member for improved resistance to depression within the snow field during traversing of the same.

4. The snow shoe as claimed in claim 3, wherein said at least one transverse bar comprises a first bar at the forward end of the central section of the I-beam frame member and a second transverse bar disposed rearwardly at the rear of said flexible toe binding, said I-beam frame member transverse bars having diameters in excess of said holes within the I-beam frame member riser and terminating at opposed end portions of reduced diameter which project through said holes of said frame member on opposite sides thereof, swaged collars secured to the projecting ends of said bars, and wherein said frame member is split with the split ends abutting each other at the rear and opposed thin metal strips sandwiched to opposite sides of said I-beam frame member riser spanning the gap between opposed ends and being riveted to each other to form a rigid unitary frame member.

5. The snow shoe as claimed in claim 4, wherein said means for effecting lacing of said at least one strap comprises a plurality of D-rings, said at least one strap being laced to said D-rings and riveted to a side of said flexible material toe binding, and wherein a spring biased clamp is mounted to one side of said flexible strip material toe binding at a point remote from attachment of said at least one strap and recives the free end of said at least one strap to lock said boot with said flexible strip material toe binding wrapped about the sides of said boot and clamped thereto.

6. An improved, light weight, high traction snow shoe comprising:

a unitary, light weight I-beam frame member of generally oval plan configuration, defining a horizontally flat middle and rear portion and terminating at its forward end in an upwardly inclined tip, at least one spreader bar fixedly mounted to said frame member and extending transversely between opposed lateral sides thereof at the forward end of the flat central section, webbing carried by said frame member between opposed lateral sides of said frame member and extending rearwardly of said transverse bar, a flat swivel toe plate pivotably mounted on said transverse bar for rotation about the axis of said bar and extending across the top of said bar and generally coplanar with the upper edge of said frame member, a flexible strip material toe binding fixedly mounted to the top of said toe plate and having lateral portions extending to each side thereof, at least one strap fixed at one end to one side of said toe binding means for effecting lacing of said strap across opposite lateral edges of said toe binding to clamp said binding to an inserted boot toe of the snow shoe wearer's boot, such that during traverse of the snow field, the wearer pivots the boot toe about the axis of said transverse bar on said swivel toe plate, and a metal strip traction device, said traction device being of a generally U-shape in plan configuration and of a width approximating the width of said frame at said at least one spreader bar, and means for fixing said metal strip traction device to said frame member beneath said flat swivel toe plate such that said U-shaped metal strip traction device penetrates the snow, and wherein the edge of said U-shaped metal strip facing away from said frame member includes integrally, a central portion transverse to the longitudinal axis of the snow shoe and laterally opposed portions parallel to the sides of the snow shoe which are notched to improve longitudinal and transverse traction for said traction device.

7. The snow shoe as claimed in claim 6, wherein said metal strip traction device is flanged on the edges in contact with and facing said frame member at the center thereof and the flanges on opposite sides being in direct contact with the bottom face of the I-beam frame member and the central flange underlying the at least one spreader bar, closed eye bolts mounted to the spreader bar on opposite sides of the flat swivel toe plate and having ends projecting through the central flange and being bolted thereto, and deformable means carried by the flanges on said opposed sides for gripping the base of said I-beam frame member such that said metal strip traction device is securely locked to the snow shoe.

8. A strip metal traction device for providing traction in a snow shoe comprised of a frame member of generally oval plan configuration and for fixedly mounting to said frame member, said traction device being U-shaped in plan configuration and having a middle portion spanning between the opposed lateral sides of said frame member and opposed side portions extending in the same direction along respective frame member lateral sides, flanges integral with the opposed side portions of said traction device and bearing means for fixing the flanges to the opposed lateral sides of the snow shoe frame member, and means for fixing said transverse middle portion of said U-shaped metal strip traction device to a spreader bar extending transversely between said opposed lateral sides of said frame member, and notches formed within the edge of said metal strip traction device facing away from said snow shoe frame member along said middle and side portions for gripping the snow during penetration thereof for effectively resisting both longitudinal and lateral movement of said snow shoe.

* * * * *